US008732909B2

(12) United States Patent
Fellman

(10) Patent No.: US 8,732,909 B2
(45) Date of Patent: May 27, 2014

(54) HINGE PROFILE FIXABLE IN A SUPPORTING PROFILE

(75) Inventor: Bernt Fellman, Stockholm (SE)

(73) Assignee: GSAB Blassmästeribranschens Service AB, Skogås (SE)

( * ) Notice: Subject to any disclaimer, the term of this patent is extended or adjusted under 35 U.S.C. 154(b) by 235 days.

(21) Appl. No.: 13/128,324

(22) PCT Filed: Jun. 22, 2010

(86) PCT No.: PCT/SE2010/000172
§ 371 (c)(1),
(2), (4) Date: May 9, 2011

(87) PCT Pub. No.: WO2010/151201
PCT Pub. Date: Dec. 29, 2010

(65) Prior Publication Data

US 2011/0214254 A1 Sep. 8, 2011

(30) Foreign Application Priority Data

Jun. 22, 2009 (SE) ..... 0900838

(51) Int. Cl.
*E05D 5/00* (2006.01)

(52) U.S. Cl.
USPC ..... 16/382; 16/387; 16/388

(58) Field of Classification Search
USPC ..... 16/382–383, 252–253, 387–392, 900, 16/DIG. 25, 235, 242–243; 24/514, 569
See application file for complete search history.

(56) References Cited

U.S. PATENT DOCUMENTS

| | | | | | |
|---|---|---|---|---|---|
| 1,650,793 | A * | 11/1927 | Hill | 70/74 |
| 2,061,727 | A * | 11/1936 | Cheney | 292/281 |
| 5,588,181 | A * | 12/1996 | Sutton | 16/252 |
| 6,126,115 | A * | 10/2000 | Carrier et al. | 244/173.3 |
| 7,350,272 | B2 * | 4/2008 | Fries | 16/246 |
| 8,079,114 | B2 * | 12/2011 | Fries et al. | 16/243 |
| 8,234,753 | B2 * | 8/2012 | Cook | 16/262 |
| 2003/0024072 | A1 * | 2/2003 | Nussbaum | 16/235 |

FOREIGN PATENT DOCUMENTS

DE 20 2006 008 327 U1 8/2006

* cited by examiner

*Primary Examiner* — Robert J Sandy
*Assistant Examiner* — Matthew Sullivan
(74) *Attorney, Agent, or Firm* — Dickstein Shapiro LLP

(57) ABSTRACT

A hinge profile (2) fixable in a supporting profile (1) intended to be used for a sheet unit e.g. in the form of a door, said supporting profile (1) is in the first place intended to be fastened to a wall. The supporting profile (1) has the form of an U, the legs (3,4) of which are directed towards, envelope and cooperate with two legs (5,6) having an inner friction surface (7) protruding from the hinge profile (2), the supporting profile (1) further having in the same in pairs provided angle-bent fixing profiles (8,9), the front portions (10) of which constitute legs (12,13) with friction surfaces (14), the back portions (11) of the fixing profiles (8,9) are displaceable a short distance from each other by help of at least one adjusting screw (15) at the same time as the front portions (10) are displaced in a transverse direction relatively each other to an adjustable engagement with the friction surface (7) of the hinge profile (2), whereby the hinge profile (2) is fixed into a selected, predetermined position in the supporting profile (1).

5 Claims, 1 Drawing Sheet

HINGE PROFILE FIXABLE IN A SUPPORTING PROFILE

The present invention refers to an improvement in and relating to hinge profile fixable in a supporting profile for a sheet unit e.g. in the form of a door, said supporting profile is in the first place intended to be secured against a wall or the like and is intended to support said hinge profile at the same time as the latter during a mounting work in a simple way being can be oriented in a predetermined distance from the supporting profile at the same time as an adjustment of each profile relatively each other is possible.

Existing supporting and hinge profiles used today for doors of different types and especially shower glass doors comprise normally different types a fastening means, which are difficult to fix into position relatively a wall and a door in a desired and correct position, which results in time consuming mounting processes.

One object of the present invention is to eliminate these drawbacks and provide an improvement of a hinge profile fixable in a supporting profile, which is very simple to mount in a correct position in a short time, so that there also is a possibility to make adjustments afterwards by turning an adjustment screw, which is easy to reach. The characterizing features of the invention are set forth in the following claims.

Thanks to the invention an improvement of hinge profile fixable in a supporting profile has been provided, which allows a quick and easy mounting and adjustment afterwards at the same time as an exact fixing into position of respective profile in relation to each other is possible, which is very important when a door is going to be mounted in the hinge profile, so that it thereafter can be guided and closed exactly in said hinge profile when mounted.

Figure 1:
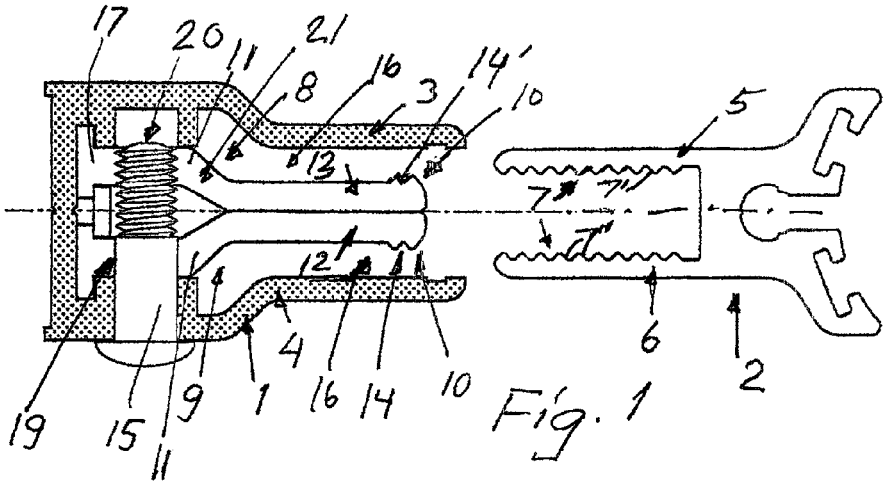
Figure 2:
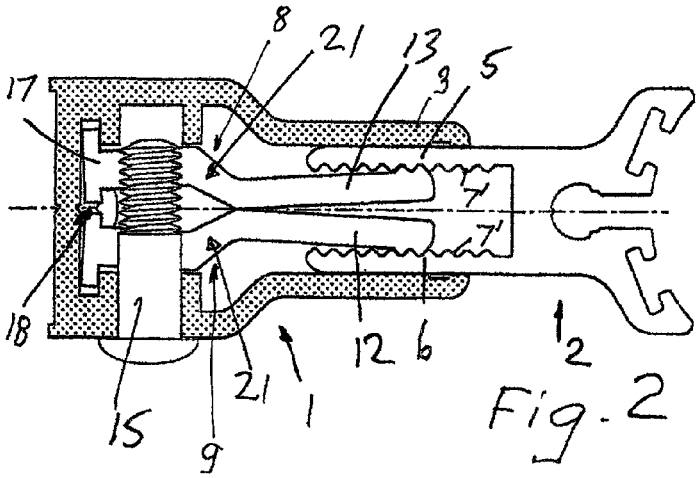
Figure 3:
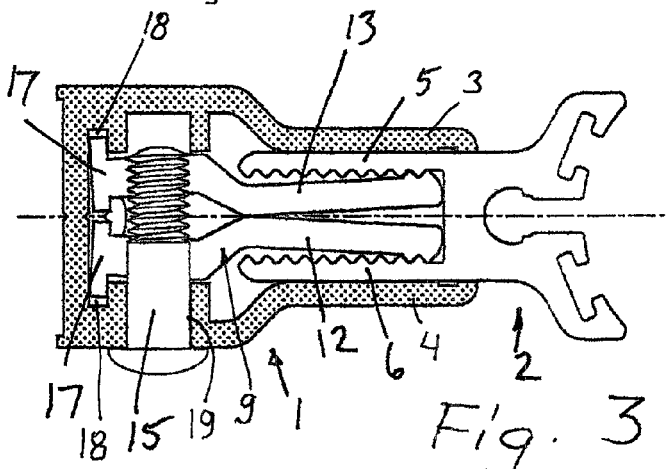
Figure 4:
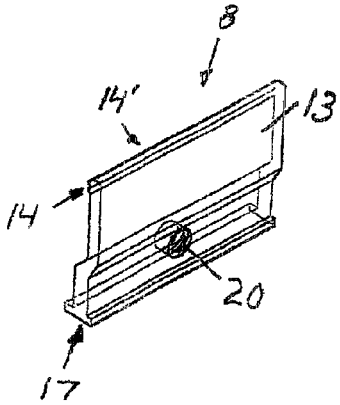

The invention is described closer below with help of a preferred embodiment example with reference to the drawings enclosed, in which FIG. 1 shows a cross section view through a supporting profile and a hinge profile before the fixing of the latter in said supporting profile, FIG. 2 shows a cross section view of the profiles illustrated in FIG. 1 where the hinge profile has been fixed in a first selected position in the supporting profile after turning of the adjustment screw, FIG. 3 shows in a cross section view of the profiles illustrated in FIG. 1 where the hinge profile has been fixed into position in another selectable position in the supporting profile after turning the adjustment screw, and FIG. 4 shows a schematic perspective view in a smaller scale and partly in section of one of the two angle bent fixing profiles cooperating with each other and which with help of an adjustment screw can bring apart its front portions during fixing of the hinge profile in said supporting profile.

According to a preferred embodiment example of the invention the same relates to an improvement of a hinge profile 2, which can be fixed into a supporting profile 1 intended for a sheet unit e.g. in the form of a door, said supporting profile 1 is intended in the first place to be fastened against a wall or the like. The supporting profile 1 has the form of an U, the legs 3,4 of which are directed towards, envelope and cooperate with two legs 5,6 protruding from the hinge profile 2, which have friction surfaces 7 in the form of inner, in their longitudinal direction extending tooth formations 7'. The supporting profile 1 further has in the same angle bent fixing profiles 8 and 9 provided in pairs, the front portions 10 of which constitute legs 12,13 with friction surfaces 14 in the form of gripping claws 14'. An adjustment screw 15 is provided to adjust the distance between the back portions 11 of the fixing profiles 8, 9 at the same time as the front portions 10 of the legs 12,13 can be displaced in a transverse direction relatively each other to an adjustable engagement with the tooth formation 7' of the hinge profile 2, so that the hinge profile 2 can be fixed into a selected, predetermined position in said supporting profile 1.

The legs 12,13 of the fixing profiles 8,9 have a length, which corresponds to the length of the legs 5,6 of the hinge profile 2 at the same time as on both sides of the legs 12,13 there is an opening 16 before that the legs 5,6 are inserted into the supporting profile 1, said opening 16 has a width which is somewhat larger that the thickness of the legs 5,6 of the hinge profile 2, which admits an insertion of the hinge profile 2 into the supporting profile 1 when the front portions 10 of the legs 12,13 of the fixing profiles 8,9 contact each other.

The fixing profiles 8, 9 are with T-formed projections 17 fixed into position in recesses 18 viewed in transverse direction along the extension of the legs 12, 13 but displaceable in these a short distance away from and towards each other viewed along the thickness of the supporting profile 1, which allows that the adjustment screw 15 can be screwed into the back portions 11 of the fixing profiles 8,9, where the first leg 12 has a non-threaded opening 19 and the other leg 13 has a threaded opening 20. In a first position before the mounting the legs 12, 13 are, on each side of the angle bent portion 21, in parallel and after the angle bent portion 21 situated in a short distance from each other, whereby the legs 12,13 of the fixing profiles 8,9 and their front portions 10 in this situation contact each other. During the screwing of the adjustment screw 15 inwards the back portions 11 are displaced towards each other, so that the front portions 10 are brought apart and make their gripping claws 14' into engagement with the tooth formation 7' of the hinge profile 2 on its legs 5, 6, so that the two profiles 1 and 2 are fixed to each other.

The invention claimed is:

1. An adjustable mounting device, comprising:

a generally U-shaped supporting profile having opposing first and second support legs connected by a transverse connecting member;

a hinge profile having opposing first and second hinge legs extending therefrom and configured to nest between the support legs of the supporting profile, wherein a side of each hinge leg that opposes the other hinge leg has an inner friction surface;

separate and opposing first and second angle-bent fixing profiles positioned between the support legs of the supporting profile, each fixing profile comprising a front portion, and a back portion connected by an angle bent portion, wherein the front portion has an outer friction surface that faces away from the other opposing fixing profile; and at least one adjusting screw that extends through a hole in one of the support legs of the supporting profile and threadedly engages the back portion of at least one of the angle-bent fixing profiles; and wherein the angle bent portion acts as a fulcrum between the back portion and the front portion during operation of the adjusting screw.

2. An adjustable mounting device according to claim 1, wherein the inner friction surface of the hinge legs of the hinge profile consists of tooth formations extending in the longitudinal direction of the profiles and that the outer friction surface of the front portion of the fixing profiles has gripping claws situated thereon.

3. An adjustable mounting device according to claim 1, wherein the front portions of the fixing profiles have a length corresponding to the length of the hinge legs of the hinge profile, and wherein the fixing profiles and support legs are positioned such that the first hinge leg is capable of sliding between the first support leg and the front portion of the first fixing profile, and the second hinge leg is capable of sliding between the second support leg and the front portion of the second fixing profile.

4. An adjustable mounting device according to claim 1, wherein the fixing profiles are, by help of their back portions, having T-formed projections fixed into position in recesses along the longitudinal direction of support legs of the supporting profile but are in transverse direction displaceable in these a short distance away from and towards each other viewed along the thickness of the supporting profile.

5. An adjustable mounting device according to claim 2, wherein the adjustment screw can be screwed through the back portions of the fixing profiles, which are parallel and angle-bent to a short distance from each other at the same time as the front portions of the fixing profiles first contact each other and thereafter, when the adjustment screw is screwed inwards, move away from each other, such that the gripping claws engage the tooth formations of the hinge legs.

* * * * *

UNITED STATES PATENT AND TRADEMARK OFFICE

CERTIFICATE OF CORRECTION

PATENT NO. : 8,732,909 B2
APPLICATION NO. : 13/128324
DATED : May 27, 2014
INVENTOR(S) : Bernt Fellman It is certified that error appears in the above-identified patent and that said Letters Patent is hereby corrected as shown below:

On the title page, Item (73), Assignee, "GSAB Blassmästeribranschens Service AB" should be changed to -- GSAB Glasmästeribranschens Service AB --

Signed and Sealed this
Second Day of December, 2014

Michelle K. Lee

Michelle K. Lee
*Deputy Director of the United States Patent and Trademark Office*